United States Patent [19]

Bielman

[11] 4,224,753

[45] Sep. 30, 1980

[54] SAFETY DEVICE FOR FIREARMS

[76] Inventor: Thomas F. Bielman, Box 373 Star Route 550, Marquette, Mich. 49855

[21] Appl. No.: 931,137

[22] Filed: Aug. 4, 1978

[51] Int. Cl.[3] ..... F41C 27/00

[52] U.S. Cl. ..... 42/1 LP

[58] Field of Search ..... 42/1 LP, 1 N

[56] References Cited

U.S. PATENT DOCUMENTS

| | | | |
|---|---|---|---|
| 2,478,098 | 8/1949 | Hansen | 42/1 LP |
| 2,763,081 | 9/1956 | Hockabee | 42/1 LP |
| 2,887,807 | 5/1959 | Santangelo | 42/1 LP |
| 3,022,598 | 2/1962 | Wikstrom | 42/1 LP |
| 3,027,674 | 4/1962 | Mahan | 42/1 LP |
| 3,137,957 | 6/1964 | Ingalls | 42/1 LP |
| 3,154,874 | 11/1964 | Stewart | 42/1 LP |
| 3,360,880 | 1/1968 | Finnegan | 42/1 LP |
| 3,368,297 | 2/1968 | Lentz | 42/1 LP |
| 3,564,746 | 2/1971 | McConnell | 42/1 N |
| 4,023,294 | 5/1977 | Knopp | 42/1 LP |
| 4,100,693 | 7/1978 | Cech | 42/1 N |
| 4,136,476 | 1/1979 | Hetrick | 42/1 LP |

FOREIGN PATENT DOCUMENTS

| | | | |
|---|---|---|---|
| 22837 | 12/1912 | Norway | 42/1 LP |

*Primary Examiner*—Charles T. Jordan

*Attorney, Agent, or Firm*—Albert L. Jeffers

[57] ABSTRACT

A safety device for firearms includes a dummy cartridge adapted to be seated in the chamber of the barrel. An elongated rod is threaded into the nose of the bullet end of the dummy cartridge. A muzzle cap is attached to the other end of the rod and is seated in and closes the muzzle. The muzzle cap is adapted to be engaged by a hand tool thereby to unthread the rod from the dummy cartridge to permit removal of the rod and muzzle cap from the muzzle of the firearm and the dummy cartridge from the chamber. A porous sleeve impregnated with a material which emits a rust inhibiting vapor may be placed on the rod between the dummy cartridge and the muzzle cap.

2 Claims, 5 Drawing Figures

10
30
28
26
20
22
18
24
50
12
48
64
58
16
60
56
54
52
62
4
4
3
3

26
44
40
42
22
36
24
46
38
34
32

54
52
61

14
64
12
48

26
44
72
68
66
40'
70
22'
36'
46'
24'
34'

SAFETY DEVICE FOR FIREARMS

BACKGROUND OF THE INVENTION

1. Field of the Invention

This invention relates generally to safety devices for firearms for rendering the same tamper-proof and harmless.

2. Description of the Prior Art

Numerous devices have been proposed for rendering a firearm tamper-proof and harmless in such places as gun shops and homes with children. Typical of such prior safety devices are those shown and described in U.S. Pat. Nos. 4,023,294; 3,360,880; 3,027,674; 3,022,598; and 2,887,807. However, certain of such prior devices have employed an elongated plug element having lands thereon for fitting in the rifling of the barrel and others have employed dummy shells having complicated spring-actuated mechanisms therein. It is therefore desirable to provide a safety device for firearms characterized by its simplicity, relatively low cost, and ease of assembly and disassembly. Furthermore, there is a need for providing rust inhibitation in the barrel of the firearm during periods when it is not in use and none of the prior safety devices known to the present applicant include means for providing such protection.

SUMMARY OF THE INVENTION

In its broader aspects, the invention provides a safety device for a firearm including a barrel having a muzzle end and a cartridge-receiving chamber at the opposite end. The device includes a dummy chartridge adapted to be seated in the chamber and having a bullet nose end and a rim end. An elongated rod element is provided having opposite ends and adapted to extend through the barrel from the muzzle into the chamber. A muzzle cap element is provided on one end of the rod element and is adapted to be seated in and close the muzzle. The bullet nose end of the dummy chartridge has means for threadedly receiving the opposite end of the rod element thereby to retain the cap element in the muzzle.

In a preferred embodiment, an elongated sleeve surrounds the rod element intermediate the bullet nose end of the dummy chartridge and the muzzle cap element and is impregnated with a material which emits a rust inhibiting vapor thereby to protect the barrel of the firearm during periods of non-use.

It is accordingly an object of the invention to provide an improved safety device for rendering a firearm tamper proof and harmless.

Another object of the invention is to provide an improved safety device for firearms characterized by its simplicity, ease of assembly and disassembly, and relatively low cost.

A further object of the invention is to provide an improved safety device for firearms incorporating means for inhibiting rust in the barrel of the firearm during periods of non-use.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figures 1, 2, 3, 4, 5:
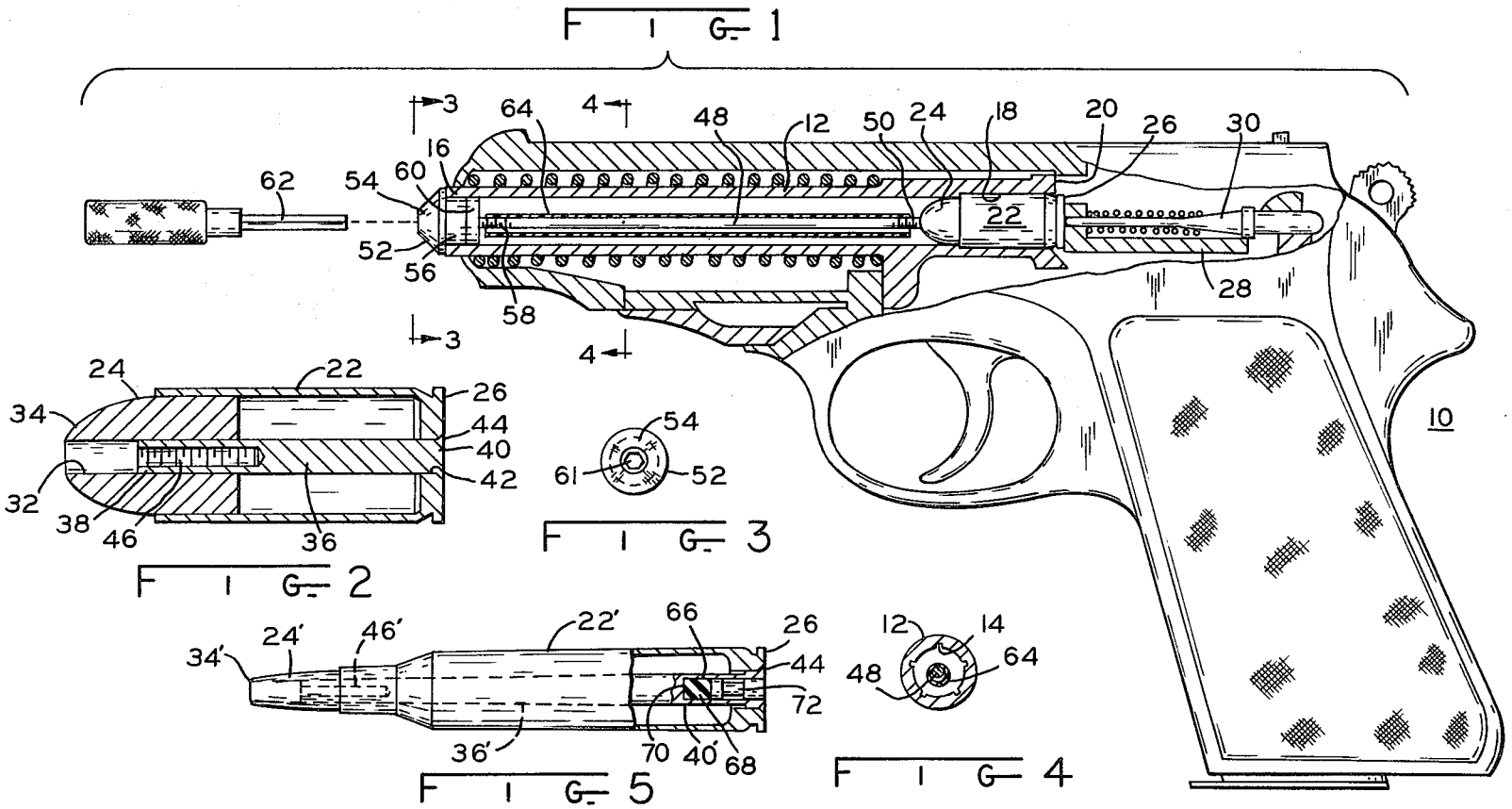
FIG. 1 is a side view, partly in cross-section, illustrating the improved safety device of the invention installed in a conventional pistol.
FIG. 2 is an enlarged, cross-sectional view showing the dummy cartridge employed in the safety device of FIG. 1.
FIG. 3 is an end view of the muzzle cap element as viewed, along the line 3—3 of FIG. 1.
FIG. 4 is a fragmentary, cross-sectional view taken generally along the line 4—4 of FIG. 1.
FIG. 5 is a side view, partly in cross-section, showing a modified form of dummy cartridge usable in the invention.

Referring now to FIGS. 1 through 4 of the drawing, an automatic pistol of conventional construction is shown, generally indicated at 10. Pistol 10 includes barrel 12 which may be rifled, as shown at 14 in FIG. 4. Barrel 12 has muzzle end 16 and chamber 18 at its other end 20.

The improved safety device of the invention includes dummy cartridge 22 proportioned to be seated in chamber 18 and having dummy bullet 24 and rim 26. Bolt 28 having firing pin 30 therein engages rim 26 of dummy bullet 22 when the same is seated in chamber 18. A conventional extractor/ejector (not shown) engages rim 26 when dummy cartridge 22 is in chamber 18.

Referring more particularly to FIG. 2, dummy bullet 24 of dummy cartridge 22 has coaxial opening 32 formed in its nose 34. Retainer member 36, which may be formed of brass, has end 38 seated in opening 32 in dummy bullet 24 and its other end 40 extending through cap opening 42 in rim 26 and is crimped thereto, as at 44. End 38 of retainer member 36 has internally threaded opening 46 therein. It will now be seen that dummy cartridge 22 can readily be provided for a particular firearm 10 by removing the load and firing cap from a cartridge suitable for use in that firearm, drilling opening 32 in bullet 24, replacing the bullet in the shell casing and recrimping the casing thereto, and then inserting retaining member 36 through cap opening 42 in rim 26 into opening 32 and crimping end 40 to rim 26.

Rod element 48 is provided having threaded end 50 extending into opening 38 in nose 34 of dummy bullet 24 and threadedly engaged with threaded opening 46 in end 38 of retainer member 36. Muzzle cap member 52 having cap portion 54 and plug portion 56 is threaded on threaded end 58 of rod element 48 and is secured in position thereon by cylindrical locknut member 60. It will be seen that plug portion 56 of muzzle cap member 52 is seated in muzzle 16 of barrel 12 and that cap portion 54 closes muzzle 16. Cap portion 54 of muzzle cap member 52 has hex opening 61 therein for receiving a suitable Allen wrench 62 thereby to thread and unthread threaded end 50 of rod element 48 into and out of engagement with threaded opening 46 in retainer member 36 of dummy cartridge 22.

It will now be seen that dummy cartridge 22 may be loaded in chamber 18 in conventional fashion in the same manner as a loaded cartridge would be loaded therein, rim 26 then being engaged by bolt 28 and by the extractor/ejector (not shown) in conventional fashion. Rod element 48 is then inserted in barrel 12 and its end 50 inserted in opening 32 in dummy bullet 24 and, with the aid of Allen wrench 62, threaded into threaded opening 46 in retainer member 36 until plug portion 56 of muzzle cap member 52 enters muzzle end 16 of barrel 12 and cap portion 54 engages muzzle 16. It will now be seen that as thus assembled, it is impossible to eject dummy cartridge 22 since engagement of muzzle cap member 52 with muzzle end 16 of barrel 12 and its connection by rod element 48 to dummy cartridge 22 prevents ejection of dummy cartridge 22 and subsequent loading of a loaded cartridge in chamber 18. It will be seen that nothing can be placed in either end of barrel 12 and, in the case of most types of firearms, the bolt cannot be drawn back, the firearm cannot be armed, and in the case of a revolver, the cylinder cannot be rotated.

In order to adapt the safety device of the invention to a particular firearm, a dummy cartridge 22 is provided as above described and loaded into chamber 18. An over-length barrel rod 48 is provided and its end 50 is threaded into threaded opening 46 in retainer member 36 in dummy cartridge 22 hand-tight and then backed-off about two turns. The end of barrel rod 48 which projects from muzzle 16 of barrel 12 is then marked flush with the end of the barrel, rod 48 is unthreaded from dummy cartridge 22, and the excess length is then cut-off at the mark. Additional threads are then cut in end 58 of barrel rod 48, if needed, and lock nut 60 is then threaded on end 58 for about one-half inch. Muzzle cap 54 is then threaded on end 58 of barrel rod 48 until it is finger-tight following which lock nut 60 is tightened against muzzle cap member 52 using modest force, as with pliars. Barrel rod 48 will thus be of the correct length for connection to dummy cartridge 22 with the use of hand tool 62 as above described. While cap portion 54 of muzzle cap member 52 may be adapted for engagement with other types of tools, the hex opening 61 is preferred since disassembly of the safety device by more commonly available hand tools is thus inhibited.

In order to inhibit rusting of the interior of barrel 12, paper tube 64 is positioned on barrel rod 48 between dummy cartridge 22 and muzzle cap member 52, and is impregnated or saturated with a small amount of vapor phase corrosion inhibiting material, such as Dicyclohexalamine (Dcha), $2(C_6H_{11})$ NH. Dcha vaporizes when exposed to the atmosphere and has a strong attraction to any exposed metal surface. Thus, when the chemical vapor comes in contact with the bore of barrel 12, it forms a very thin, i.e., a few molecules thick, iron-amine compound. This thin film will remain until the Dcha is allowed to evaporate or boil-off in the open air; however, with barrel 12 closed at both ends of dummy cartridge 22 and muzzle cap member 52, the Dcha impregnated in paper tube 64 and the resultant thin film on the bore of barrel 12 will remain effective for many months.

Referring now to FIG. 5 in which like elements are indicated by like reference numerals and similar elements by primed reference numerals, a dummy cartridge 22' is shown having a conventional configuration different from that shown in FIGS. 1 and 2. Here, retainer member 36' has opening 66 formed in end 40'. Shock absorber 68 formed of suitable resilient material, such as rubber, is seated in opening 66 against bottom end 70 thereof. Dummy primer plunger 72 is seated in opening 66 against shock absorber element 68, as shown. Resilient shock absorber element 68 relieves the shock on firing pin 30 when "dry firing" firearm 10 after the safety device of the invention has been installed and secured; many gun owners object to releasing the firing pin into an empty chamber.

Muzzle cap member 52 and barrel rod 48 may be formed of any suitable material, such as brass. When a brass or other shinny metal muzzle cap member 52 is employed, and with the only visible part of the safety device being the shinny muzzle cap portion 54 at the muzzle end of barrel 12, the small, bright protrusion serves to indicate that the safety device has been installed and that the firearm is thus safe. It will be readily seen that if a live cartridge is in chamber 18 rather than dummy cartridge 22, barrel rod 48 cannot be inserted in barrel 12 sufficiently properly to seat muzzle cap member 52 in muzzle end 16. Dummy cartridge 22 is preferably finished with a dark or black finish to distinguish it from live rounds thus inhibiting the possibility of chambering a live round of ammunition while attempting to install the safety device.

It will be seen that the safety device of the invention can be employed on nearly every type of firearm which uses cartridge-type ammunition including pistols, rifles and shotguns of the bolt action, semi-automatic, slide and break-open types. It will be seen further that the improved safety device of the invention renders a firearm useless in so far as live ammunition is concerned and also makes it impossible to insert any object in either end of the barrel thus eliminating the possibility of loading and firing the firearm with a foreign object in the barrel. Live rounds can be stored in the magazine or clip and a live round loaded in the chamber by removing barrel rod 48 and muzzle cap member 52 and ejecting the dummy cartridge 22. It will thus be seen that the safety device of the invention is a deterrent to accidental or rash firing of the weapon thus avoiding accidents and spur-of-the-moment reactions. The safety device of the invention also encourages gun owners to inspect and maintain their firearms in a responsible manner. A particular advantage of the safety device of the invention is the fact that it utilizes a dummy cartridge which can be simply provided from an actual cartridge used with the particular firearm.

While there have been described above the principles of this invention in connection with specific apparatus, it is to be clearly understood that this description is made only by way of example and not as a limitation to the scope of the invention.

What is claimed is:

1. A safety device for a firearm including a barrel having a muzzle end and a cartridge-receiving chamber at the opposite end, and a firing pin, comprising: a dummy cartridge adapted to be seated in said chamber and having a bullet nose end and a rim end; an elongated rod element having opposite ends and adapted to extend through said barrel from said muzzle into said chamber; and a muzzle cap element on one end of said rod element and adapted to be seated in and close said muzzle end; said bullet nose end of said dummy cartridge having means for removably receiving the opposite end of said rod element thereby to retain said cap element in said muzzle, said receiving means comprising an elongated retainer member having opposite ends with one end seated in an opening in said nose end and its other end extending through an opening in said rim end and being secured therein, said one end of said retainer member having a threaded opening therein for threadedly receiving said opposite end of said rod element.

2. The device of claim 1 wherein said other end of said retainer member has an opening therein, said opening having a bottom, and further comprising a resilient shock absorber element seated in said retainer member opening against said bottom thereof, and a plunger member in said retainer member opening and having opposite ends with one end engaging said shock absorber element and the other end being a dummy cap adapted to be struck by the firing pin of said firearm.

* * * * *